US005272900A

United States Patent [19]

Robbins

[11] Patent Number: 5,272,900

[45] Date of Patent: Dec. 28, 1993

[54] BAYONET STYLE CONNECTOR FOR METAL EXTRUSION DUMMY BLOCK

[75] Inventor: Paul H. Robbins, Aurora, Canada

[73] Assignee: Exco Technologies, Limited, Markham, Canada

[21] Appl. No.: 947,168

[22] Filed: Sep. 18, 1992

[51] Int. Cl.[5] ..... B21C 26/00

[52] U.S. Cl. ..... 72/273

[58] Field of Search ..... 72/273, 273.5, 253.1, 72/478, 264, 265

[56] References Cited

U.S. PATENT DOCUMENTS

| | | | |
|---|---|---|---|
| 3,282,075 | 11/1966 | Zhookoff | 72/273 |
| 3,385,091 | 5/1968 | Hess | 72/273 |
| 3,581,544 | 6/1971 | Grimes | 72/253 |
| 3,616,672 | 11/1971 | Moos | 72/270 |
| 3,820,374 | 6/1974 | Braeuninger | 72/265 |
| 3,826,122 | 7/1974 | Braeuninger | 72/264 |
| 3,919,873 | 11/1975 | Biswas et al. | 72/273 |
| 4,052,877 | 10/1977 | Zilges et al. | 72/273 |
| 4,212,182 | 7/1980 | Steyvers et al. | 72/273 |
| 4,286,453 | 9/1981 | Exner | 72/273 |
| 4,342,212 | 8/1982 | Sibler | 72/255 |
| 4,550,584 | 11/1985 | Degen | 72/273 |
| 5,048,592 | 9/1991 | Mueller | 164/312 |
| 5,054,303 | 10/1991 | Newman | 72/38 |

FOREIGN PATENT DOCUMENTS

| | | | |
|---|---|---|---|
| 1190518 | 7/1985 | Canada . | |
| 0110015 | 5/1991 | Japan | 72/273 |
| 0569354 | 8/1977 | U.S.S.R. | 72/273 |
| 0664705 | 5/1979 | U.S.S.R. | 72/273.5 |
| 0897361 | 1/1982 | U.S.S.R. | 72/273.5 |

*Primary Examiner*—Lowell A. Larson
*Assistant Examiner*—Michael J. McKeon
*Attorney, Agent, or Firm*—Basile and Hanlon

[57] ABSTRACT

In a circular dummy block for use in an extrusion press for extruding through a die, extrudable metal, a bayonet type coupler for connecting the dummy block to a stem of the extrusion press. The bayonet type coupler comprises:

i) a post having on its outer end portion a first set of lugs of the bayonet style coupler, ii) a recess in the stem and having about its periphery a second set of lugs complementary to the first set to complete the bayonet style coupler, iii) a connector for connecting an inner end portion of the post to the dummy block, the connector being adapted to permit longitudinal movement of the dummy block along the post toward the outer end portion and permit lateral movement of the dummy block relative to the post, such longitudinal and lateral movement of the dummy block relative to the post allowing the dummy block to float during use in an extrusion press, and iv) a lock device in the stem for fixing the post once the bayonet coupler is assembled by inserting the outer end portion in the recess to locate the first set of lugs inwardly of the second set of lugs and rotating the post to lock the first set of lugs behind the second set of lugs.

6 Claims, 2 Drawing Sheets

FIG.1.
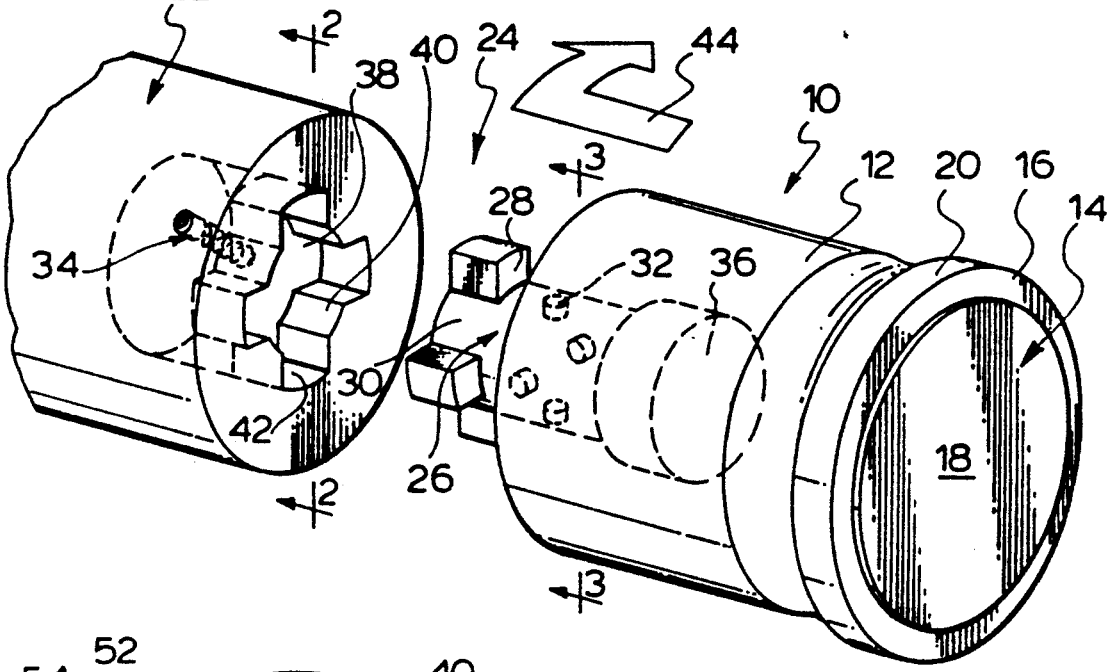
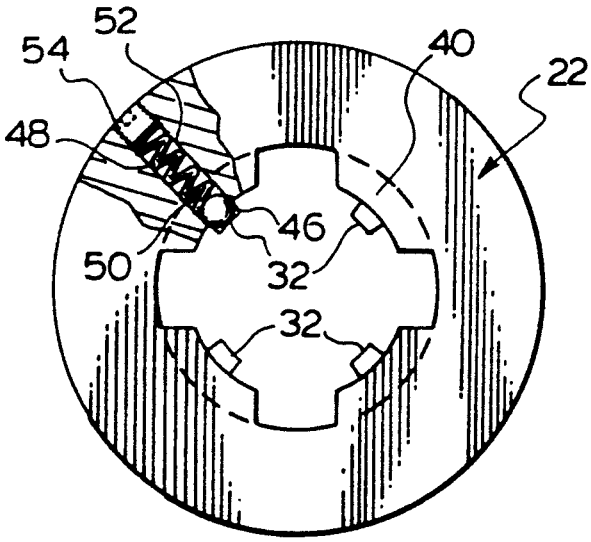
FIG.2.
FIG.3.
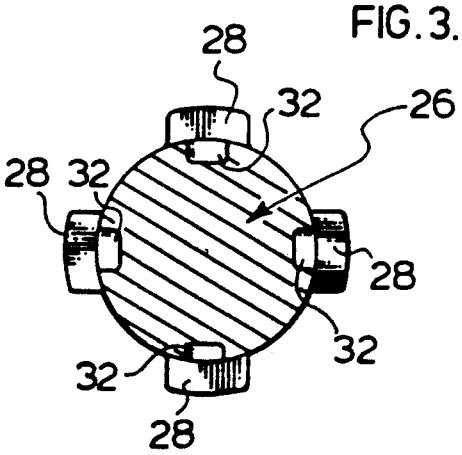

BAYONET STYLE CONNECTOR FOR METAL EXTRUSION DUMMY BLOCK

FIELD OF THE INVENTION

This invention relates to coupling devices for connecting a dummy block to a stem commonly used in extrusion presses, particularly for extruding malleable metals through a die.

BACKGROUND OF THE INVENTION

An example of a dummy block as secured to a stem is disclosed in U.S. Pat. No. 3,385,091. Such dummy blocks are commonly used to protect the stem portion and allow the dummy block to be made of material different from that of the stem. As shown in U.S. Pat. No. 3,385,091, the dummy block is secured to the stem by way of threaded engagement. Another form of threaded engagement of the dummy block to the stem is demonstrated in Canadian patent 1,190,518. Such threaded coupling of the dummy block to the stem of the extrusion press can create several problems during use. One of the most difficult problems in the assembly of the dummy block to the stem is that the dummy block may be at temperatures in excess of 800° F. thereby necessitating care and the use of tools to effect the threading of the dummy block onto the stem. Occasionally, improper threading of the dummy block on the stem can result in cross-threading and hence, require re-threading of either or both of the dummy block and stem. Furthermore, improper threading can result in misalignment of the dummy block within the cylinder of the extrusion press container. This can require shutdown and reassembly or if the dummy block enters the container and is cycled through an extrusion cycle, the improperly threaded dummy block can strip the threads of the stem and virtually be welded thereto. This necessitates opening of the container and the use of a cutting torch to remove the dummy block from the stem.

It is also generally understood that over prolonged use of any threaded arrangement the threads can wear necessitating re-threading of either the stem and/or dummy block. It is also necessary in the assembly of the dummy block to the stem that the dummy block be positioned at a predetermined distance from the stem. This is particularly important in instances where it is desired that the dummy block float relative to the stem by virtue of the dummy block being able to move longitudinally of the stem as well as laterally thereof. It is not always possible during quick assembly of the dummy block to the stem to ensure that the correct spacing between the two components is provided.

SUMMARY OF THE INVENTION

The coupling assembly in accordance with this invention for coupling the dummy block to the stem overcomes a number of the above problems. In a circular dummy block for use in an extrusion press for extruding through a die extrudable metal, a bayonet type coupler for connecting the dummy block to the stem of the extrusion press is provided. The bayonet type coupler comprises:

i) a post having on its outer end portion a first set of lugs of the bayonet style coupler, ii) a recess in the stem and having about its periphery a second set of lugs complementary to the first set to complete the bayonet style coupler, iii) means for connecting an inner end portion of the post to the dummy block, the connecting means is adapted to permit longitudinal movement of the dummy block along the post toward the outer end portion and permit lateral movement of the dummy block relative to the post, such longitudinal and lateral movement of the dummy block relative to the post allowing the dummy block to float during use in an extrusion press, iv) means is provided in the stem for fixing the post once the bayonet coupler is assembled by inserting the outer end portion in the recess to locate the first set of lugs inwardly of the second set of lugs and rotating the post to lock the first set of lugs behind the second set of lugs.

BRIEF DESCRIPTION OF THE DRAWINGS

Preferred embodiments of the invention are shown in the drawings wherein:

FIG. 1 is an exploded perspective view of a first embodiment of the bayonet type coupler of this invention for use in connecting the dummy block to the stem.

FIG. 2 is a section along the lines 2—2 of the dummy block of FIG. 1.

FIG. 3 is a section along the lines 3—3 of the stem of FIG. 1.

DETAILED DESCRIPTION OF THE PREFERRED EMBODIMENTS

Figure 4:
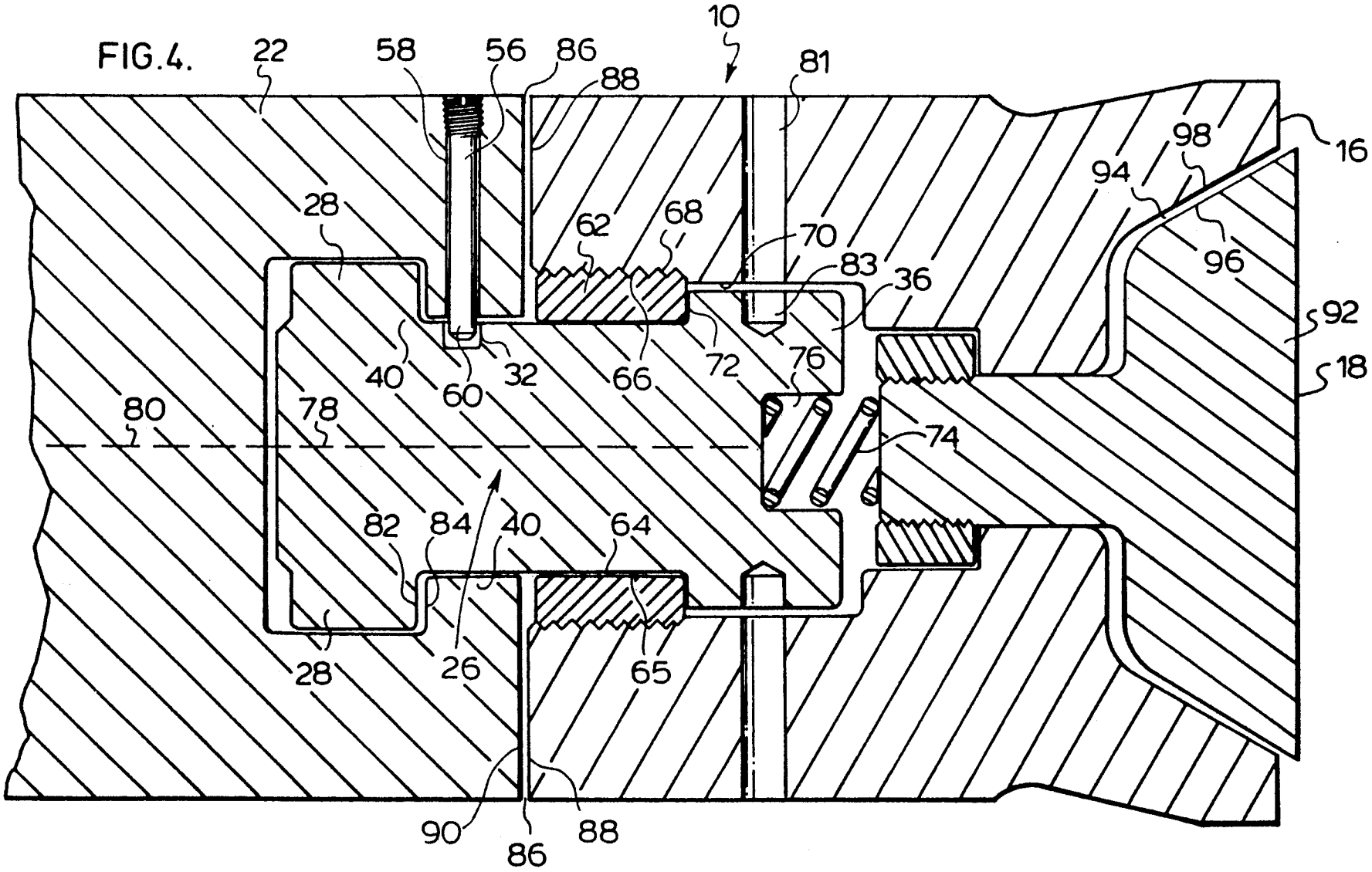
FIG. 4 is a longitudinal section of the dummy block assembled to the stem with an alternative embodiment for fixing the rotational position of the bayonet type connector within the stem of the extrusion press.

Metal extrusion presses are commonly used to extrude a variety of malleable metals. Such metals include aluminum, alloys of aluminum, copper and various alloys such as bronze, brass and the like, and also lead and various alloys of lead. The normal metal extrusion press has a container ,in which a metal billet at elevated temperature is placed. The extrusion die is at one end of the container. The dummy block, as mounted on the extrusion press stem, enters the container and presses against the metal billet. In the normal extrusion process, there is the usual degassing cycle to void the container of gases therein. As the billet upsets and begins to flow, it is extruded through the die of the metal extrusion press to form a longitudinally extended extrusion of the desire shape. A preferred mechanism for mechanically venting gases from the container as a supplement to the degassing cycle, is described in applicant's co-pending application U.S. application Ser. No. 07/947,167 filed Sep. 18, 1992 and entitled "Metal Extrusion Dummy Block Having a Spring Loaded Valve".

It is routine to mount a dummy block on the stem of the extrusion press for the reason previously described and in particular to protect the stem. The dummy block is mounted on the stem in a manner to allow both longitudinal and lateral movement thereof relative to the stem so that the dummy block, in essence, floats relative to the stem. This accommodates movement of the dummy block relative to the stem as the stem advances into the container of the extrusion press. Such movement is normal in accommodating variations in the alignment of the stem relative to the container cylinder bore and possible movement of the stem relative to the container bore.

A preferred arrangement for the dummy block in which this invention may be employed is shown in FIG. 1. The dummy block 10 has a body portion 12 and a press face, generally designated 14, which comprises annular face portion 16 and circular face portion 18. Circular face portion 18 is part of a valve member used in mechanically venting gases from the container prior to and up to upset of the metal billet in the extrusion press. In operation, the valve member recedes into the dummy block such that face 18 becomes flush with face 16 to press the metal billet along the container in the usual manner. As already noted, details of the mechanical venting device are disclosed in applicant's co-pending application Ser. No. 07/947,167. The dummy block is sized such that the annular ring portion 20 contacts the cylindrical bore of the container to ensure that the metal billet advances in the container and is not extruded out through the die.

The feature of this invention is then the manner in which the dummy block 10 is secured to the stem 22. As shown in FIG. 1 and generally designated 24, a bayonet type of coupler is used to connect the dummy block 10 to the stem 22. The dummy block 10 carries a post 26 having outwardly extending lugs 28. The lugs 28 are positioned on the outer end portion 30 of the post 26. Inwardly of the post 26 are located four dimples 32 which, in a manner to be discussed with respect to FIGS. 2 and 3, interact with a securing device, generally designated 34, as provided on the stem 22. On the inner end portion 36 of the post 26 is a device for locating and connecting the inner end portion to the dummy block, the details of which are described with respect to FIG. 4.

The stem 22 is provided with a recess 38 which extends a sufficient depth into the stem 22 to accommodate the post 26 in a manner to allow the lugs 28 to enter behind the corresponding lugs 40 of the recess. The lugs 40 are positioned about the periphery of the recess to define corresponding notches 42. In order to lock the lugs 28 in the recess 38 behind the respective lugs 40 of the stem, the post is inserted in an orientation such that the lugs 28 pass through the notches 22, then the dummy block is rotated in a direction of arrow 44 to position the lugs 28 behind the respective lugs 40 on the stem. With the particular embodiment shown, having four lugs as the first set of lugs on the post and four lugs as the second set of lugs on the stem, it is only necessary to rotate the post of the dummy block 22½° to effect positioning of the lugs 28 behind the lugs 40. The device 34 then interacts with the dimple 32 to fix the lugs in that position.

With reference to FIG. 3, the post 26 has the four radially extending lugs 28. Inwardly of those lugs 28 are the aforementioned dimples 32. As shown in FIG. 2, a ball member 46 is spring loaded by spring 48. The ball 46 is secured to the end 50 of the spring and positioned in the bore 52 by threaded bolt 54. As the post 26 is inserted into the recess 38, the ball is pushed inwardly of the bore 52. Once the post has rotated in the direction of arrow 44 the ball 46 clicks or snaps into the dimple 32 to not only indicate with an audible sound the location of the lugs 28 behind the lugs 40, but as well to retain the post in that locked position with the lugs 28 behind the lugs 40 of the stem 22.

The bayonet type coupling, according to this invention, readily couples the dummy block 10 to the stem 22 in a positive manner which consistently ensures the floating of the dummy block relative to the stem and also a positive locking of the dummy block in position relative to the stem in a consistent manner to be discussed in more detail with respect to FIG. 4.

As shown in FIG. 4, an alternative embodiment is used to lock the post 26 with its lugs 28 positioned behind the corresponding lugs 40 on the stem 22. Instead of the spring loaded ball member 46, a threaded stud 56 is threaded through bore 58 in the stem 22. The end 60 of the threaded stud 56 contacts the body portion of the post 26 and, in accordance with this embodiment, enters a dimple 32 to fix or in essence lock the lugs 28 behind the lugs 40 of the stem 22.

The manner in which the bayonet coupler of this invention ensures a positive consistent location of the dummy block 10 relative to the stem 22 is shown. The post 26 is mounted within the dummy block 10 by way of an externally threaded collar 62. The externally threaded collar is usually provided on the cylindrical portion 64 of the post 26 before the lugs 28 are formed. The collar 62 has an external threaded portion 66 which threadably engages the internal threaded portion 68 of the bore 70 within the dummy block 10. The collar 62 engages annular shoulder 72 on the post 26 to locate its innermost end portion 36 within the dummy block 10. The cylindrical portion 64 of the post 26 may slide inwardly of the collar 62. However, it can only extend out of the dummy block until the shoulder 72 abuts the collar 62.

According to the particular embodiment shown in FIG. 4, a compression spring 74 is mounted in the dummy block within a recess 76 of the post 26 and is under a pre-set compression to bias the post 26 outwardly so that the shoulder 72 contacts the collar 62. The spring not only serves the purpose of ensuring that the post 26 is in its outermost position but also ensures that the longitudinal axis 78 of the post 26 is aligned with the longitudinal axis 80 of the stem 22. This facilitates mounting of the dummy block 10 to the stem 22. If the lugs 28 do not align exactly with the recesses or notches 42 of the stem, the spring 74 absorbs the blow and avoids damage to the lugs 28 or the lugs 40. Furthermore, the spring 74, in forcing the post 26 outwardly of the dummy block 10, acts to frictionally locate the lugs relative to the dummy block so that when the dummy block is rotated in the direction of arrow 44 the post 26 and correspondingly the lugs 28 move with the dummy block so that in a 22½ turn the lugs 28 are appropriately positioned behind the lugs 40 of the recess. In turn, the appropriate mechanism for fixing the post position, that is, either the spring loaded ball 46 or the locking stud 56 are located for locking up the post. It is understood that devices other than the spring 74 may be used to ensure rotation of the post during coupling of the bayonet coupler. A suitable friction washer in the dummy block and engaging the post 26 could be used to effect the necessary rotation, but allow the dummy block to rotate relative to the stem when in use. Alternatively, a rod may be inserted through keyhole 8 in dummy block body portion 12 and into blind hole 83 of the end portion 36 of the post to rotate in unison the block and post for purposes of locking up the bayonet connector.

With the lugs 28 positioned behind the lugs 40, as shown in FIG. 4, the lug faces 82 of the lugs 28 contact faces 84 of the corresponding lugs 40. This determines the space 86 between the face 88 of the dummy block 10 and the face 90 of the stem 22. The space 86 ensures that the dummy block 10 is permitted to float relative to the stem 22 during initial positioning of the dummy block 10 within the container of extrusion press. As the dummy block 10 contacts the metal billet the valve member 92, which is involved in the mechanical venting of gases from the container retracts into the dummy block such that face 18 becomes flush with face 16. Such retraction of the valve member 92 accommodated by the spring 74. As discussed in more detail in applicant's co-pending application Ser. No.07/947,167, the spring 74 has a pre-set spring resistance to ensure that the valve member 92 does not retract within the dummy block until the metal billet in the container is about to or has completed upsetting. This ensures that gases are properly vented through the space 94 defined between the valve member 92 and the dummy block 10. As the valve member 92 retracts into the dummy block 10 and closes the space 94, the face 96 of the valve member contacts the face 98 of the dummy block to in turn push the dummy block 10 rearwardly towards the stem 22 closing up the gap 86. The full forces of stem advancing into the container is then transferred through to the dummy block by the abutment of faces 88 of the dummy block with the stem 90. By virtue of the fitting of the post 26 in the dummy block, which accommodates both lateral and longitudinal movement thereof, the dummy block is free to move laterally relative to the stem that is across the longitudinal axis 80 of the stem to accommodate variations during the stroke of the stem and furthermore, the dummy block 10 is allowed to rotate relative to the stem 22 should such rotation induced by extrusion of the metal billet through the die. The rotation of the dummy block 10 is allowed by overcoming frictional engagement between the faces 88 and 90 as the collar 62 rotates around the post portion 64 on the bearing face 65.

In accordance with the above description of the invention, it is apparent that the bayonet type coupling for connecting the dummy block to the extrusion stem facilitates handling and connection, particularly when the dummy block is at elevated temperatures. The bayonet coupling ensures a consistent mounting of the dummy block on the stem and avoids problems associated with threaded couplings of dummy blocks to the stem.

Although preferred embodiments of the invention are described herein in detail, it will be understood by those skilled in the art that variations may be made thereto without departing from the spirit of the invention or the scope of the appended claims.

I claim:

1. In a circular dummy block for use in an extrusion press for extruding extrudable metal through a die, a bayonet type coupler for connecting said dummy block to a stem of the extrusion press, said stem having a longitudinal axis, said bayonet type coupler comprising:

i) a post having on its outer end portion a first set of lugs of said bayonet style coupler, ii) a recess in said stem and having about its periphery a second set of lugs complementary to said first set to complete said bayonet style coupler, iii) means for connecting an inner end portion of said post to said dummy block, said connecting means being adapted to permit longitudinal movement of said dummy block along said post toward said outer end portion and permit lateral movement of said dummy block relative to said stem and across said stem longitudinal axis, such longitudinal and lateral movement of said dummy block relative to said post allowing said dummy block to float during use in an extrusion press, iv) means in said stem for fixing said post once said bayonet coupler is assembled by inserting said outer end portion in said recess to locate said first set of lugs inwardly of said second set of lugs and rotating said post to fix said first set of lugs behind said second set of lugs.

2. In a circular dummy block of claim 1, means for locating said post and retaining its position to permit locking of said first set of lugs behind said second set of lugs, said locating means permitting rotation of said dummy block when in use on an extrusion press.

3. In a circular dummy block of claim 1, said dummy block having a resilient biasing means to bias said post rearwardly of said dummy block.

4. In a circular dummy block of claim 1, said longitudinal movement of said dummy block as permitted by said connecting means, allowing said stem to abut said dummy block when in use on an extrusion press.

5. In a circular dummy block of claim 1, said means for fixing said post in said stem is a spring loaded ball which engages a corresponding dimple in said post.

6. In a circular dummy block of claim 1, said means for fixing said post in said stem is a set screw for engaging said post.

* * * * *